US008100121B2

(12) United States Patent
Clauss et al.

(10) Patent No.: US 8,100,121 B2
(45) Date of Patent: Jan. 24, 2012

(54) TIMER FOR A GAS COOKING HOB

(75) Inventors: Stéphane Clauss, Lipsheim (FR); Andreas Gromer, Rastatt (DE); Martin Oberhomburg, Wetter (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 284 days.

(21) Appl. No.: 11/990,536

(22) PCT Filed: Jul. 31, 2006

(86) PCT No.: PCT/EP2006/064835

§ 371 (c)(1),
(2), (4) Date: Feb. 15, 2008

(87) PCT Pub. No.: WO2007/020178

PCT Pub. Date: Feb. 22, 2007

(65) Prior Publication Data

US 2008/0276923 A1 Nov. 13, 2008

(30) Foreign Application Priority Data

Aug. 16, 2005 (EP) ..... 05017742

(51) Int. Cl.
*G05D 7/06* (2006.01)
*F23N 5/24* (2006.01)

(52) U.S. Cl. ..... 126/42; 126/39 R; 126/39 H; 126/391; 126/25 R; 99/339; 99/390

(58) Field of Classification Search ..... 126/42, 126/391, 25 R, 25 A; 99/339, 390
See application file for complete search history.

(56) References Cited

U.S. PATENT DOCUMENTS

| | | | | | |
|---|---|---|---|---|---|
| 2,626,661 | A | * | 1/1953 | McDowell | 431/15 |
| 3,529,584 | A | * | 9/1970 | Celaya | 126/39 N |
| 4,681,530 | A | * | 7/1987 | Huber | 431/89 |
| 5,355,214 | A | * | 10/1994 | Hammer | 356/315 |
| 5,355,241 | A | * | 10/1994 | Kelley | 398/170 |
| 5,575,638 | A | | 11/1996 | Witham et al. | |

(Continued)

FOREIGN PATENT DOCUMENTS

EP 0 727 616 8/1996

(Continued)

OTHER PUBLICATIONS

International Search Report PCT/EP2006/064835.

*Primary Examiner* — Steven B McAllister
*Assistant Examiner* — Nikhil Mashruwala
(74) *Attorney, Agent, or Firm* — James E. Howard; Andre Pallapies

(57) ABSTRACT

A gas cooking hob comprising a number of gas burners, each of which is connected to a main gas pipe via a gas pipe section, and a main switch. The main gas pipe or the gas pipe section is open to supply gas to the gas burners when the main switch is actuated while a gas supply to the gas burners is interrupted when the main switch is actuated once again. In order to be able to jointly interrupt gas supply to all gas burners even without the user acting directly upon the main switch, a timing member is assigned to the main switch in order to adjust an interval after which the main switch closes automatically.

15 Claims, 1 Drawing Sheet

U.S. PATENT DOCUMENTS

Figure 1:
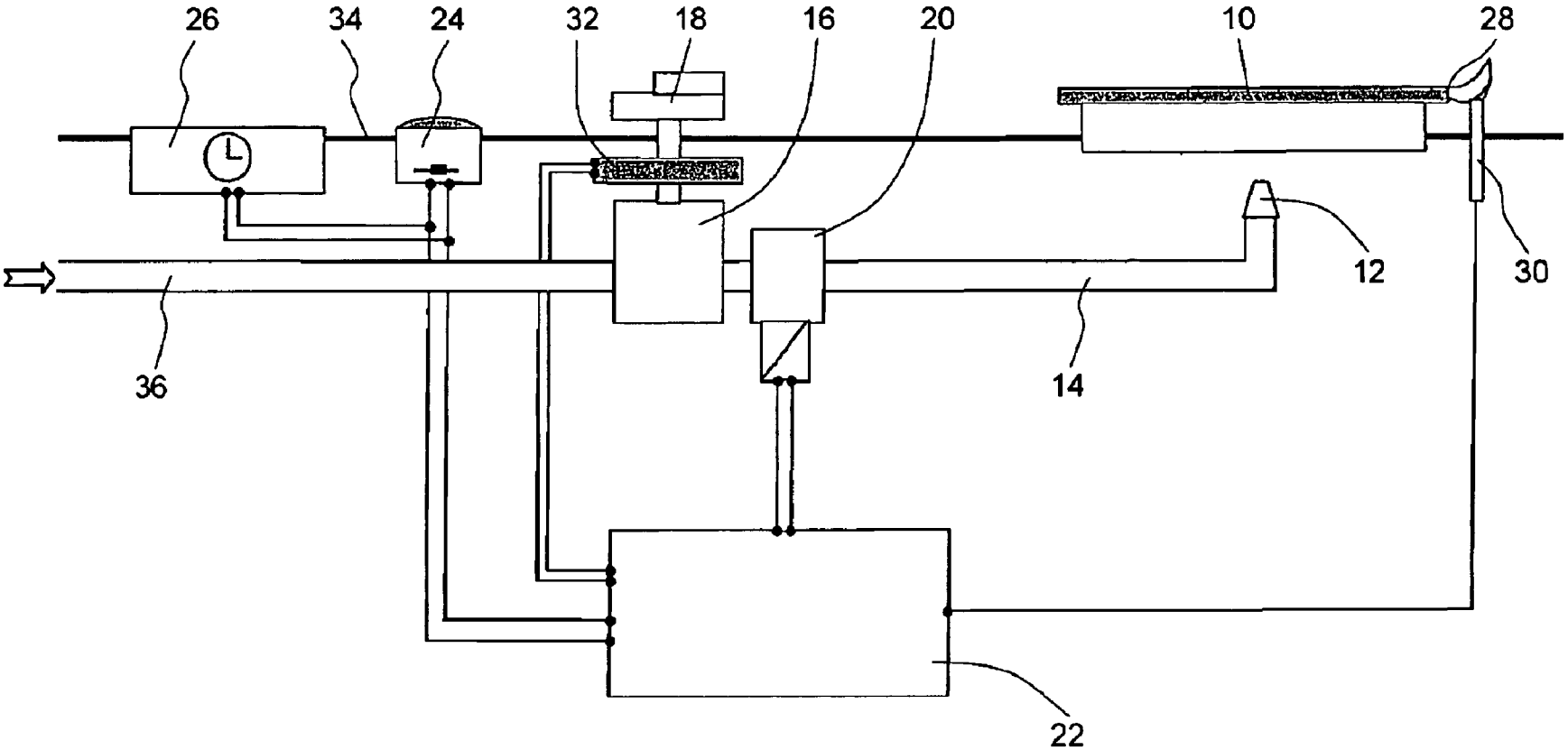

| | | | | |
|---|---|---|---|---|
| 5,694,916 | A | 12/1997 | Gambill et al. | |
| 5,813,320 | A * | 9/1998 | Frasnetti et al. | 99/333 |
| 5,954,045 | A | 9/1999 | Bhanot | |
| 6,289,792 | B1 * | 9/2001 | Grando et al. | 99/332 |
| 6,316,357 | B1 * | 11/2001 | Lin et al. | 438/662 |
| 6,318,357 | B1 * | 11/2001 | Muhle et al. | 126/39 R |
| 7,150,626 | B2 | 12/2006 | Clauss et al. | |
| 2002/0045142 | A1 | 4/2002 | Repper et al. | |
| 2004/0069293 | A1 | 4/2004 | Steurer | |

FOREIGN PATENT DOCUMENTS

| | | | |
|---|---|---|---|
| EP | 0 802 374 | | 10/1997 |
| GB | 2179425 | A * | 8/1985 |
| JP | 40404096 | A * | 6/1990 |
| JP | 404040967 | A * | 12/1992 |

* cited by examiner

TIMER FOR A GAS COOKING HOB

The invention relates to a gas cooking hob with a number of gas burners, each of which is connected to a main gas pipe via a gas pipe section, and a main switch, which, when actuated, opens the main gas pipe of the gas pipe section to supply gas to the gas burners and which, when actuated again, interrupts a gas supply to the gas burners.

A gas cooking hob with a number of gas burners is known from U.S. Pat. No. 5,954,045, with gas being supplied to each gas burner via a gas pipe. Each of the gas pipes is connected to the main gas pipe via a gas tap, in which a main valve to be actuated manually is arranged. This gas tap can be used to interrupt the gas supply for the entire cooker, i.e. for all gas burners. The object of the invention is to provide a gas cooking hob, in which even without the direct involvement of the user, an interruption to the gas feed for all gas burners is possible.

This object is achieved with a gas cooking hob with the features of clam 1. In accordance with the characterizing part of clam 1 the main switch is assigned a timing element for setting a time interval, and after this timing element has timed out the main switch closes automatically. This means that on the one hand the gas supply to all gas burners of the cooking hob is interrupted after the interval timed by the timer element has elapsed. On the other hand however the invention provides for just a single timer element for the entire gas cooking hob. This thus ensures that operation of the gas cooking hob is simple and easy to understand.

The invention ensures that the gas cooking hob can be isolated from the gas supply reliably and in a planned way, i.e. if the user does not switch of this supply because of lack of attention or not being present to do so.

It is thus possible to use the timer element to interrupt the gas supply for the entire gas cooking hob at the same time. For this purpose the timer element can be set mechanically or programmed electronically in accordance with an advantageous embodiment of the invention. In the setting or programming for example a fixed point in time can be entered at which the electronic control unit causes the safety valves or the main safety valve to close. As an alternative to a point in time, a period of time can be entered after which the electronic control unit causes the safety valves or the main safety valve to close. The setting or programming can in this case for example be undertaken using a rotary knob, a switch or a button, or by means a radio-operated remote control.

In accordance with a further advantageous embodiment of the invention the timer switch element can signal the selected setting or the programming undertaken in addition or as an alternative. The signaling can be optical and/or acoustic. For a mechanical setting of the timer switch element a pointer on a scale is the obvious solution. In its electrical variant the timer switch element can display information on a digital display. The timer switch element can thus also serve as a short alarm timer or an "egg timer". In addition to signaling the elapsed time it can at the same time relieve the user of the task of switching of the gas cooking hob.

According to a further advantageous embodiment of the invention the timer switch element can be a component of the electronic control unit and be able to be programmed via operation and display elements. The operating and display elements of the timer switch element can then advantageously be arranged in a control panel of the gas cooking hob alongside operating and display elements for the gas burners for example. The timer switch element function can thus be accommodated in a space-saving and low-cost way in the control unit which is provided in any event. Inventively the gas cooking hob also features a main switch connected to the electronic control unit, with which independently of the timer switch element the simultaneous closure of all safety valves or of the main safety valve is able to be undertaken. For this purpose the main switch is connected in parallel to the timer switch element in relation to the control unit. The gas cooking hob can thus be isolated totally and especially before the set or programmed time from the gas supply with the aid of the main switch. The main switch thereby allows fast and effective intervention into the operation of the gas cooking hob, in order to avoid any possible damage for example to the unit itself or to the cooking utensils.

As an alternative the electronic control unit can also feature just one signal input which is used to receive a switching signal from the timer switch element or from the main switch. In this embodiment both the timer switch element and also the main switch are connected in parallel to one signal input of the electronic control unit. The simultaneous closure of all safety valves or of the main safety valve is then effected by the first switching signal sent by the timer switch element or by the main switch.

The principle of the invention is explained by way of an example in greater detail below with reference to a figure.

The single FIG. 1 shows a schematic diagram of the layout of a gas cooking hob.

For simplicity's sake only one gas burner 10 is shown. A nozzle 12 which is connected to a gas pipe 14 is arranged in the gas burner 10. A gas tap 16 is arranged in the gas pipe 14, with which the amount of gas supplied to the nozzle 12 is able to be set. The gas tap 16 is operated via a rotary knob 18. A valve 20, which in this embodiment is embodied as a magnetic valve, is arranged in the gas pipe 14 between the gas tap 16 and the nozzle 12. The electrical part of the magnetic valve 20 is connected to a central electronic control unit 22. A main switch 24 is also connected to it, with which a timer switch element 26 is connected in parallel. The control unit 22 is in addition linked electrically to the rotary switch 32 which transfers the switch setting of the rotary knob 18 and thereby directly the degree of opening of the gas tap 16 as a signal to the control unit 22.

The gas burner 10 has flame outlet openings 28. Arranged in their vicinity is a sensor 30 in contact with the control unit 22, for example a thermoelement. The temperature at the flame outlet openings 28 of the gas burner 10 is measured with the aid of the sensor 30. The control unit 22 receives from sensor 30 a temperature-dependent voltage signal, which can be used for flame monitoring for example.

In operation the rotary switch 32 signals to the control unit 22 that the gas supply to the nozzle 12 has been opened by means of the gas tap 16. The sensor 30 monitors whether a flame is created at the gas burner 10. If the sensor 30 does not measure any temperature increase at the gas burner 10, the control unit 22 closes the magnetic valve 20 and thus interrupts the gas feed to the nozzle 12. If a flame is formed at the flame outlet openings 28 in accordance with specifications, the control unit 22 maintains the gas supply to the nozzle 12, which can then be adjusted with the rotary knob 18. The rotary switch 32 transfers the respective setting of the rotary knob 18 to the control unit 22. It controls the operation of the gas burner 10 depending on the setting of the rotary knob 18 and the setting of the sensor 30. For example, with a fully open gas tap 16, but an extinguished flame, it closes the magnetic valve 20, in order to prevent a dangerous escape of gas. The main switch 24 is integrated into a control panel 34 close to the rotary knob 18 and the timer switch element 26 and is embodied as a manual pushbutton. The magnetic valve 20 can be closed via the main switch 24 and the control unit 22 at any time during of the operation of the gas cooking hob and independently of the timer switch element 26. The timer switch element 26 can be used to preset or program a point in time or a period of time, so that, when the given time is reached or the given period of time has elapsed the magnetic valve is 20 closed and there by the gas supply to nozzle 12 is interrupted. Because of the parallel connection of main switch 24 and timer switch element 26 the main switch 24 can thus be manually activated or pressed even when the hob is under timer control.

An inventive gas cooking hob comprises a number of gas burners 10 (not shown in FIG. 1), to which a nozzle 12 with a gas pipe 14 and a gas tap 16 respectively is assigned. A magnetic valve 20 is arranged between gas tap 16 and nozzle 12 in the gas pipe 14 for each gas burner. All magnetic valves 20 are controlled by a control unit 22. After activation of the main switch 24 the control unit 22 simultaneously closes all magnetic valves 20. In an alternative embodiment of invention not shown a main safety valve can be arranged in the main gas line 36, which can likewise be embodied as an electromagnetic valve and which is connected to the control unit 22. On activation of the main switch 24, manually or timed, the main safety valve can also be closed instead of or in addition to the magnetic valve 20. The aim in each case is the simultaneous interruption of the gas supply for all gas burners 10.

The use of the indefinite article "a or an" does not preclude more than one of the relevant features being present.

LIST OF REFERENCE SYMBOLS

10 Gas burner
12 Nozzle
14 Gas pipe
16 Gas tap
18 Rotary switch
20 Safety valve
22 Electronic control unit
24 Main switch
26 Timer switch element
28 Flame outlet opening
30 Sensor
32 Rotary switch
34 Control panel
36 Main gas pipe

The invention claimed is:

1. A gas cooking hob comprising:

a plurality of gas burners;

a control unit;

a main gas pipe;

a plurality of gas pipe sections with each of the gas burners being connected to the main gas pipe via a respective gas pipe section;

a switch controlled valve, the switch controlled valve being associated with a given one of the gas pipe sections or with the main gas pipe and the switch controlled valve being operable in a gas flow mode to permit the flow of gas such that gas flows to the gas burners and being operable in a supply interruption mode to block the flow of gas such that no gas flows to the gas burners;

a timer element, the timer element being operatively associated with the switch controlled valve such that the switch controlled valve operates in a timed cut-off operation in which the switch controlled valve is in the gas flow mode permitting the flow of gas and is thereafter switched into the supply interruption mode blocking the flow of gas when a timed cut-off point is reached at the expiration of a predetermined time interval as determined by the timer element; and a manually operated switch, the manually operated switch being operatively associated with the switch controlled valve and the manually operated switch being operable in a manual cut-off override operation in which, during the course of a given timed cut-off operation of the switch controlled valve wherein the switch controlled valve is permitting the flow of gas and a respective timed cut-off point to be reached at the expiration of a predetermined time interval as determined by the timer element has not yet been reached, a manual actuation of the manually operated switch results in the switch controlled valve switching into the supply interruption mode so that the switch controlled valve blocks the flow of gas, thereby resulting in an interruption of gas flow to the gas burners at a time before the respective timed cut-off point of the given timed cut-off operation has been reached, wherein output of the manually operated switch and output of the timer element are provided as inputs to the control unit and the control unit controls the switch controlled valve.

2. The gas cooking hob as claimed in claim 1 and further comprising a plurality of gas taps, each gas tap being associated with a respective one of the gas pipe sections for controlling the gas supply to the respective gas burner supplied by the respective gas pipe section.

3. The gas cooking hob as claimed in claim 1 and further comprising a plurality of additional switch controlled valves, each additional switch controlled valve being associated with a respective one of the gas pipe sections and the manually operated switch being operatively associated with the additional switch controlled valves.

4. The gas cooking hob as claimed in claim 1, wherein the switch controlled valve is a main valve associated with the main gas pipe.

5. The gas cooking hob as claimed in claim 1, wherein the timer element provides an optical and/or acoustical signal indicating the setting or programming of the predetermined time interval.

6. The gas cooking hob as claimed in claim 1, wherein, during a heating operation to heat an item, a timed cut-off operation is commenced during which the switch controlled valve operates in the gas flow mode permitting the flow of gas to the gas burners, the gas burners combust the gas supplied thereto in a combustion process that heats the item, and the timed cut-off point of the timed cut-off operation is set before the end of the combustion process that heats the item.

7. The gas cooking hob as set forth in claim 6, wherein the timer element provides an optical and/or acoustical signal indicating the setting or programming of the predetermined time interval.

8. The gas cooking hob as claimed in claim 1, wherein the timer element and the manually operated switch are integrated in one component.

9. The gas cooking hob as claimed in claim 1, wherein the switch controlled valve is a valve associated with one of the plurality of gas pipe sections, the gas cooking hub further comprising a plurality of additional switch controlled valves, each additional switch controlled valve being associated with a respective one of the gas pipe sections, wherein the timer element and the manually operated switch are operatively associated with the switch controlled valve and the plurality of additional switch controlled valves, and wherein the supply interruption mode is activated simultaneously for the switch controlled valve and for at least one switch controlled valve of the plurality of additional switch controlled valves.

10. The gas cooking hob as claimed in claim 4 and further comprising a plurality of additional switch controlled valves, each additional switch controlled valve being associated with a respective one of the gas pipe sections, and wherein the timer element and the manually operated switch are operatively associated with the main gas pipe switch controlled valve and the plurality of additional switch controlled valves.

11. The gas cooking hob as claimed in claim 10, wherein the supply interruption mode is activated simultaneously for the main gas pipe switch controlled valve and for at least one additional switch controlled valve of the plurality of additional switch controlled valves.

12. The gas cooking hob as claimed in claim 10, wherein the supply interruption mode is activated simultaneously for each of the plurality of additional switch controlled valves without activating the supply interruption mode for the main gas pipe switch controlled valve.

13. The gas cooking hob as claimed in claim 1, wherein the predetermined time interval is set or programmed using either a period of time or a fixed point in time.

14. The gas cooking hob as claimed in claim 2, further comprising a rotary knob for each of said gas taps.

15. The gas cooking hob as claimed in claim 1, wherein the timer element and the manually operated switch are connected in parallel to the control unit.

* * * * *